US007764258B2

(12) United States Patent
Kitamura et al.

(10) Patent No.: US 7,764,258 B2
(45) Date of Patent: Jul. 27, 2010

(54) LIQUID CRYSTAL DISPLAY APPARATUS AND ALTERNATING CURRENT DRIVING METHOD THEREFORE

(75) Inventors: Sachio Kitamura, Kumamoto (JP); Yukio Ijima, Kumamoto (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 434 days.

(21) Appl. No.: 11/108,828

(22) Filed: Apr. 19, 2005

(65) Prior Publication Data

US 2005/0237287 A1 Oct. 27, 2005

(30) Foreign Application Priority Data

Apr. 26, 2004 (JP) ..... 2004-129329

(51) Int. Cl.
*G09G 3/36* (2006.01)

(52) U.S. Cl. ..... 345/96; 345/54; 345/209; 345/99; 345/94; 348/441; 348/550

(58) Field of Classification Search ..... 345/204–205, 345/214, 55, 84, 87, 96, 98–99; 348/441, 348/446, 550, 793
See application file for complete search history.

(56) References Cited

U.S. PATENT DOCUMENTS 5,270,697 A * 12/1993 Takeda ..... 345/96
5,365,284 A * 11/1994 Matsumoto et al. ..... 348/793
6,160,535 A 12/2000 Park
6,366,271 B1 * 4/2002 Kohno et al. ..... 345/103
7,098,884 B2 * 8/2006 Onoya ..... 345/96
2003/0038766 A1 2/2003 Lee et al.
2004/0178979 A1 * 9/2004 Watanabe et al. ..... 345/96
2004/0239602 A1 * 12/2004 Kim et al. ..... 345/87
2008/0170025 A1 * 7/2008 Song et al. ..... 345/96

FOREIGN PATENT DOCUMENTS

JP 11-149277 6/1999

(Continued)

OTHER PUBLICATIONS

Machine Translation of JP-2002-091392.*

(Continued)

*Primary Examiner*—Alexander Eisen
*Assistant Examiner*—Jason M Mandeville
(74) *Attorney, Agent, or Firm*—Buchanan Ingersoll & Rooney PC

(57) ABSTRACT

A liquid crystal display apparatus includes synchronization signal extracting means for extracting a vertical synchronization signal from a noninterlace signal, first reversal signal generating means for generating a first polarity reversal signal that causes reversal of polarity of a signal voltage every frame for a switching device associated with each of pixels according to the vertical synchronization signal, reversal control signal generating means for generating a reversal control signal according to a result of comparison between frames of the noninterlace signal, second reversal signal generating means for generating a second polarity reversal signal by reversing polarity of the first polarity reversal signal according to the reversal control signal, and switching device driving means for driving each of switching devices according to the second polarity reversal signal.

6 Claims, 13 Drawing Sheets

FOREIGN PATENT DOCUMENTS

| | | | |
|---|---|---|---|
| JP | 2002-091392 | A | 3/2002 |
| JP | 2004-094017 | A | 3/2004 |
| JP | 03-064179 | A | 8/2008 |
| TW | 552573 | A | 9/2003 |
| TW | 574516 | A | 2/2004 |

OTHER PUBLICATIONS

Japanese Office Action mailed Jun. 24, 2008 in corresponding Japanese Application No. 2004-129329 with English translation.
Notice of Allowance from corresponding Taiwanese Patent Application No. 094112383 dated Aug. 15, 2008.

* cited by examiner

FIG. 4A

| INPUT | | OUTPUT | |
|---|---|---|---|
| CLK | D | | |
| VERTICAL SYNCHRONIZATION SIGNAL | REVERSAL CONTROL SIGNAL | Q | QN |
| × | × | H | L |
| × | × | L | H |
| × | × | H | H |
| ↑ | H | H | L |
| ↑ | L | L | H |

FIG. 4B

| INPUT | | OUTPUT |
|---|---|---|
| 1st POLARITY REVERSAL SIGNAL | OUTPUT SIGNAL OF D-FLIP FLOP | 2nd POLARITY REVERSAL SIGNAL |
| L | L | L (NONREVERSAL) |
| H | L | H (NONREVERSAL) |
| L | H | H (REVERSAL) |
| H | H | L (REVERSAL) |

LIQUID CRYSTAL DISPLAY APPARATUS AND ALTERNATING CURRENT DRIVING METHOD THEREFORE

BACKGROUND OF THE INVENTION

1. Field of the Invention

The present invention relates to a liquid crystal display apparatus and to an alternating current driving method therefore and, more particularly, to improvement of an alternating current driving type liquid crystal display apparatus adapted to every frame is reverse the polarity of a signal voltage for a switching device, such as a thin film transistor.

2. Description of the Related Art

It is known that a phenomenon, in which characteristics of a liquid crystal is deteriorated, that is, what is called image sticking occurs in a case where a signal voltage of the same polarity is applied to the same pixel electrode for a long time. Hitherto, to prevent an occurrence of such image sticking, a technique called an "alternating current driving" method, according to which the polarity of a signal voltage written to each pixel is reversed, has been employed. For example, an occurrence of the image sticking is prevented by reversing the polarity of a signal voltage to be applied to the same pixel every frame of a video signal (see, for example, JP-A-11-149277).

FIG. 8 is a view showing the configuration of a conventional liquid crystal display apparatus. This liquid crystal display apparatus 100 is called an active matrix typed display apparatus, and includes a liquid crystal display panel portion 2, a source driving portion 101, and a gate driving portion 4. In the liquid crystal display panel portion 2, many source lines 6 and many gate lines 7, which are intersected with the source lines 6. A pixel having a switching device constituted by a thin film transistor is formed at each of the intersections there between.

The source driving portion 101 includes a signal processing portion 8, source driver ICs 9 and a polarity control portion 102, and supplies a signal voltage to each pixel through the source line 6 according to a video signal. The gate driving portion 4 includes a gate control portion 103 and gate driver ICs 104, and enables or disables the gate in the thin film transistor of each of pixels, which are respectively associated with the gate lines 7, through the associated gate line 7.

The signal processing portion 8 determines a signal voltage, which is associated with each of the pixels, according to the amplitude level of the video signal and sequentially outputs voltage data, which represent such voltages, to the source driver ICs 9. The polarity control portion 102 generates a polarity reversal signal 105, which is used for reversing the polarity of the signal voltage, according to a horizontal synchronization signal and a vertical synchronization signal, which are extracted from the video signal, and outputs the generated polarity reversal signal to each of the source driver ICs 9. Each of the source driver ICs 9 serially applies signal voltages to the source lines 6 according to this polarity reversal signal 105 and the voltage data to thereby drive each of the thin film transistors.

The gate control portion 103 outputs control data to the gate driver IC 104 according to the horizontal synchronization signal and the vertical synchronization signal, which are extracted from the video signal, to thereby control the enabling and the disabling of the gate associated with each of the gate lines 7. The gate driver IC 104 sequentially enables and disables the gates according to this control data through the gate lines 7. That is, the gates respectively associated with the gate lines 7 are sequentially enabled, so that only each of the thin film transistors provided on the single gate line 7, the associated gate of which is in an enabled state, is writable. That is, signal voltages are sequentially written to the thin film transistors, which are in such a state, through the source lines 6. At that time, the polarity of the signal voltage applied to each of the thin film transistors is reversed in response to a polarity reversal signal 105 every vertical scanning period. That is, the positive or negative polarity of the voltage applied to each of the pixels is reversed every frame of the video signal.

Further, in a dot inversion driving type apparatus, a control operation of reversing each of the polarities of the signal voltages respectively associated with adjacent pixels is performed. That is, each of the polarities of signal voltages respectively applied to the adjacent pixels provided on the gate line 7 is reversed. Additionally, each of the polarities of the signal voltages respectively applied to adjacent pixels provided between the gate lines 7 is also reversed. Such an alternating current driving operation can effectively prevent the pixels from being baked.

Generally, in a case where an interlace signal is inputted to a liquid crystal display apparatus, it is necessary to perform deinterlacing (that is, format conversion of an interlace signal to a progressive signal) by scanning-line interpolation. Usually, an interlaced scanning (or interlacing) technique to be used for enhancing resolution by utilizing an amount of information, which is as small as possible, and for smoothing motions is performed on images taken by a video camera and those received by a television receiver. One frame of such a video signal (that is, an interlace signal) is divided into two fields, and scanning is performed two times respectively associated with the two fields. For example, in the case of NTSC signals, each frame, whose frame period is (1/30) seconds, thereof is divided into an odd-numbered field and an even-numbered field. In a first half ((1/60) seconds) of the frame period, only odd-numbered scanning lines are shown. Then, in the next half ((1/60) seconds) of the frame period, only even-numbered scanning lines are shown.

However, the aforementioned conventional liquid crystal display apparatus has a problem in that when showing a noninterlace signal obtained by performing scanning-line interpolation on an interlace signal, a pixel, on which an alternating current driving operation cannot be performed, appears in a case where a same image is continuously shown over plural frames.

FIG. 9 is a state view illustrating a display screen, on which a noninterlace signal is displayed, of a conventional liquid crystal display apparatus. FIG. 9 shows the polarity of a signal voltage applied to each of pixels and also shows an even-numbered frame 111 and an odd-numbered frame 112 by comparison. Further, FIG. 9 illustrates a case where a same image is repeatedly displayed in each of the even-numbered frame 111 and the odd-numbered frame 112 on the screen and where the image shown in the even-numbered frame 111 and the image shown in the odd-numbered frame 112, which differ from each other, are alternately displayed. The even-numbered frame 111 is obtained by performing scanning-line interpolation on an even-numbered field in the interlace signal. The signal voltage applied to each of the pixels in display areas 111*b* and 111*c* other than the display area 111*a* on the screen is set to be equal to a common voltage (that is, a voltage applied to a common electrode). That is, in the display area 111*a*, a signal voltage, whose polarity is reversed every pixel and every gate line 7, is applied to each of the pixels. In the display areas 111*b* and 111*c*, the signal voltage applied to each of the pixels is set to be equal to the common voltage. In the case of the "normally black" type, the display area 111*a* is displayed white, while the display areas 111*b* and 111*c* are displayed black.

Meanwhile, the odd-numbered frame 112 is obtained by performing scanning-line interpolation on an odd-numbered field in the interlace signal. A signal voltage applied to each of the pixels in a display area 112*c* other than display areas 112*a* and 112*b* on the screen is set to be equal to the common voltage. The display areas 112*a* to 112*c* are the same as those 111*a* to 111*c*, respectively. Under each of the display screen, the signal voltage in the display areas 111*b* and 112*b*, which are the boundaries between the white display part and the black display part, are illustrated corresponding to the pixels provided on the gate line 7. In a case where such an even-numbered frame 111 and such an odd-numbered frame 112 are alternately and repeatedly displayed over plural frames, the alternatively current driving cannot be performed on each of the pixels in the display regions 111*b* and 112*b*, which are the boundaries between the white part and the black part. That is, in the display areas 111*b* and 112*b*, the application of a signal voltage having opposite polarity is not performed for a certain period.

FIG. 10 is a view illustrating the polarity of a signal voltage applied to a pixel every vertical scanning period in the conventional liquid crystal display apparatus. In the display areas 111*b* and 112*b*, the polarity of a signal voltage applied to each of the pixels is alternately 0 and, for instance, negative every vertical scanning period. Thus, the application of the signal voltage of the opposite polarity is not performed, so that the direct-current component of the signal voltage is accumulated in each of the pixels. When the direct-current component is accumulated therein, each of the pixels causes image sticking. This has adverse effects. For example, a pixel portion, in which the image sticking occurs, becomes a residual image (or causes flicker). FIG. 11 illustrates a display area 113*a*, which becomes a residual image after on the display area 113 displayed after the display screen shown in FIG. 9 is displayed (and which is the same area as each of the display areas 111*b* and 112*b*).

FIGS. 12 and 13 are state transition views each illustrating the display screen of the conventional liquid crystal display apparatus every frame. As shown in FIG. 12, the polarity of the signal voltage is reversed so that the signal voltage has the opposite polarities thereof alternately between the even-numbered frames 121, 123, and 125 and the odd-numbered frames 122, 124, and 126. Thus, the image sticking of the pixel does not occur. In contrast with this, in a case shown in FIG. 13, display areas other than those 131*a*, 133*a*, and 135*a* in even-numbered frames 131, 133, and 135, and all display areas in odd-numbered frames 132, 134, and 136 have the common voltage. In the display areas 131*a*, 133*a*, and 135*a*, no alternating current driving cannot be performed. Thus, it is possible that in a case where such a video signal is inputted, the direct-current component is accumulated in each of the pixels in the display areas to thereby cause image sticking.

As described above, the conventional liquid crystal display apparatus has problems that when a noninterlace signal obtained by performing scanning-line interpolation on an interlace signal is displayed therein, a pixel, in which alternating-current driving cannot be performed, appears in a case where a same image is continuously displayed over plural frames, and that defective indication, such as image sticking, is caused.

SUMMARY OF THE INVENTION

The invention is accomplished in view of the aforementioned circumstances. Accordingly, the invention provides a liquid crystal display apparatus that improves display quality, and provides an alternating current driving method therefor. More particularly, the invention provides a liquid crystal display apparatus enabled to restrain image sticking from being caused on pixels.

A liquid crystal display apparatus according to the invention includes synchronization signal extracting means for extracting a vertical synchronization signal from a noninterlace signal, first reversal signal generating means for generating a first polarity reversal signal that causes reversal of polarity of a signal voltage each frame for a switching device associated with each of pixels according to the vertical synchronization signal, reversal control signal generating means for generating a reversal control signal according to a result of comparison between frames of the noninterlace signal, second reversal signal generating means for generating a second polarity reversal signal by reversing polarity of the first polarity reversal signal according to the reversal control signal, and switching device driving means for driving each of switching devices according to the second polarity reversal signal.

With such a configuration, the second polarity reversal signal is generated according to the reversal control signal, which is generated according to a result of comparison between the frames. Thus, in a case where a pixel, on which alternating current driving cannot be performed, appears, the polarity of a signal voltage can be reversed according to the reversal control signal. Consequently, the pixel can be restrained from causing image sticking.

The liquid crystal display apparatus of the invention may further include interpolation processing means for generating the noninterlace signal by performing scanning line interpolation on an interlace signal, in addition to the aforementioned constituents. Further, the liquid crystal display apparatus of the invention may be configured so that the reversal control signal generating means generates a reversal control signal according to a difference in luminance between an odd-numbered frame and an even-numbered frame. With such a configuration, the reversal control signal is generated according to the difference in luminance between an odd-numbered frame, which is obtained by performing scanning line interpolation on an odd-numbered field, and an even-numbered frame obtained by performing scanning line interpolation on an even-numbered field. Thus, a reversal control signal can be generated in a case where a predetermined number of pixels or more are included in each of frames adapted so that the difference in luminance between odd-numbered ones and even-numbered ones exceeds a predetermined threshold value.

In addition to the configurations, the liquid crystal display apparatus of the invention may have a configuration in which the second reversal signal generating means includes a delay flip-flop circuit and an exclusive-OR circuit, and in which the reversal control signal and the vertical synchronization signal are inputted to the delay flip-flop circuit, and in which an output signal of the delay flip-flop circuit and the first polarity reversal signal are inputted to the exclusive-OR circuit to thereby generate a second polarity reversal signal. With such a configuration, a circuit for restraining image sticking from occurring in a pixel can be realized with a simple configuration.

According to the liquid crystal display apparatus of the invention and the alternating current driving method of the invention therefor, even in a case where a same image is continuously displayed over plural frames, the polarity of a signal voltage is reversed according to a reversal control signal. Thus, defective indication, such as image sticking of a pixel, can be restrained from occurring. Consequently, the display quality can be improved.

BRIEF DESCRIPTION OF THE DRAWINGS

FIGS. 4A and 4B are tables showing the corresponding relation between an input and an output in a delay flip-flop circuit and an exclusive-OR circuit shown in FIG. 3;

DETAILED DESCRIPTION OF THE INVENTION

First Embodiment

Figure 1:
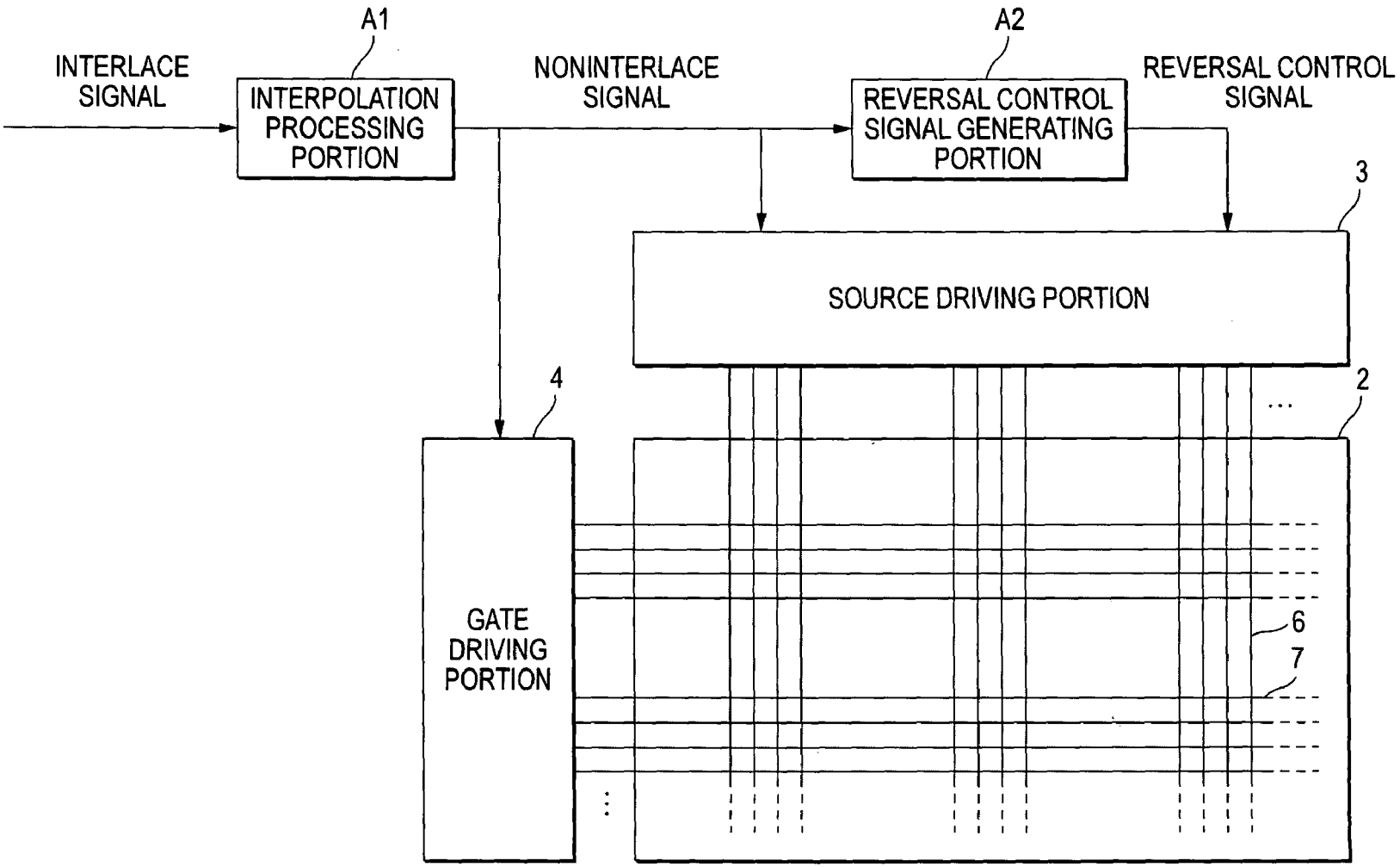
FIG. 1 is a view showing an example of the rough configuration of a liquid crystal display apparatus according to a first embodiment of the invention.

FIG. 1 is a view showing an example of the rough configuration of a liquid crystal display apparatus according to a first embodiment of the invention. In a liquid crystal apparatus according to this embodiment, an alternating current driving operation is performed according to a reversal control signal. This liquid crystal display apparatus 1 is an active matrix type display apparatus. Each of pixels arranged in a matrix-like manner has a thin film transistor serving as a switching device. This liquid crystal display apparatus 1 includes a liquid crystal display panel portion 2, a source driving portion 3, a gate driving portion 4, an interpolation processing portion A1, and a reversal control signal generating portion A2. An image based on a noninterlace signal, which is obtained by performing scanning line interpolation on an interlace signal, is displayed on the liquid crystal panel portion 2.

The interpolation processing portion A1 performs interpolation processing on an interlace signal, which is inputted from an external portion provided outside the liquid crystal display apparatus 1, and outputs a noninterlace signal. The noninterlace signals are serially generated by performing a two-dimensional IP (Interlace to Progressive) conversion on interlace signals.

The reversal control signal generating portion A2 outputs a reversal control signal, which is used for controlling an alternating current driving operation, according to a noninterlace signal outputted from the interpolation processing portion A1. This reversal control signal is generated according to a result of the comparison between the frames of the noninterlace signal, for example, the difference in luminance between an odd-numbered frame, which is obtained by performing scanning line interpolation on an odd-numbered field, and an even-numbered frame obtained by performing scanning line interpolation on an even-numbered field. That is, a predetermined number of pixels or more, which are adapted so that the difference in luminance between those of an odd-numbered frame and an even-numbered frame exceeds a predetermined threshold value, a represent in each of such frames and generated in a case where such frames are repeatedly inputted a predetermined number of times. This reversal control signal is generated, for instance, in a case where different images, one of which is displayed in each of odd-numbered frames and the other of which is displayed in each of even-numbered frames, are alternately displayed, and where a same image is displayed in each of the odd-numbered frames over a plurality of such frames, and where a same image, which differs from the image displayed in each of the odd-numbered frames, is displayed in each of the even-numbered frames over a plurality of such frames. The reversal control signal generated in this way is outputted to the source driving portion 3.

The source driving portion 3 applies a signal voltage to each of pixels through the source line 6 according to the reversal control signal, which is outputted from the reversal control signal generating portion A2, and to the noninterlace signal outputted from the interpolation processing portion A1. The gate driving portion 4 enables and disables a gate of the thin film transistor of each of the pixels, which are provided on each of the gate lines 7, through the associated gate line 7 according to the noninterlace signal outputted from the interpolation processing portion A1.

Figure 2:
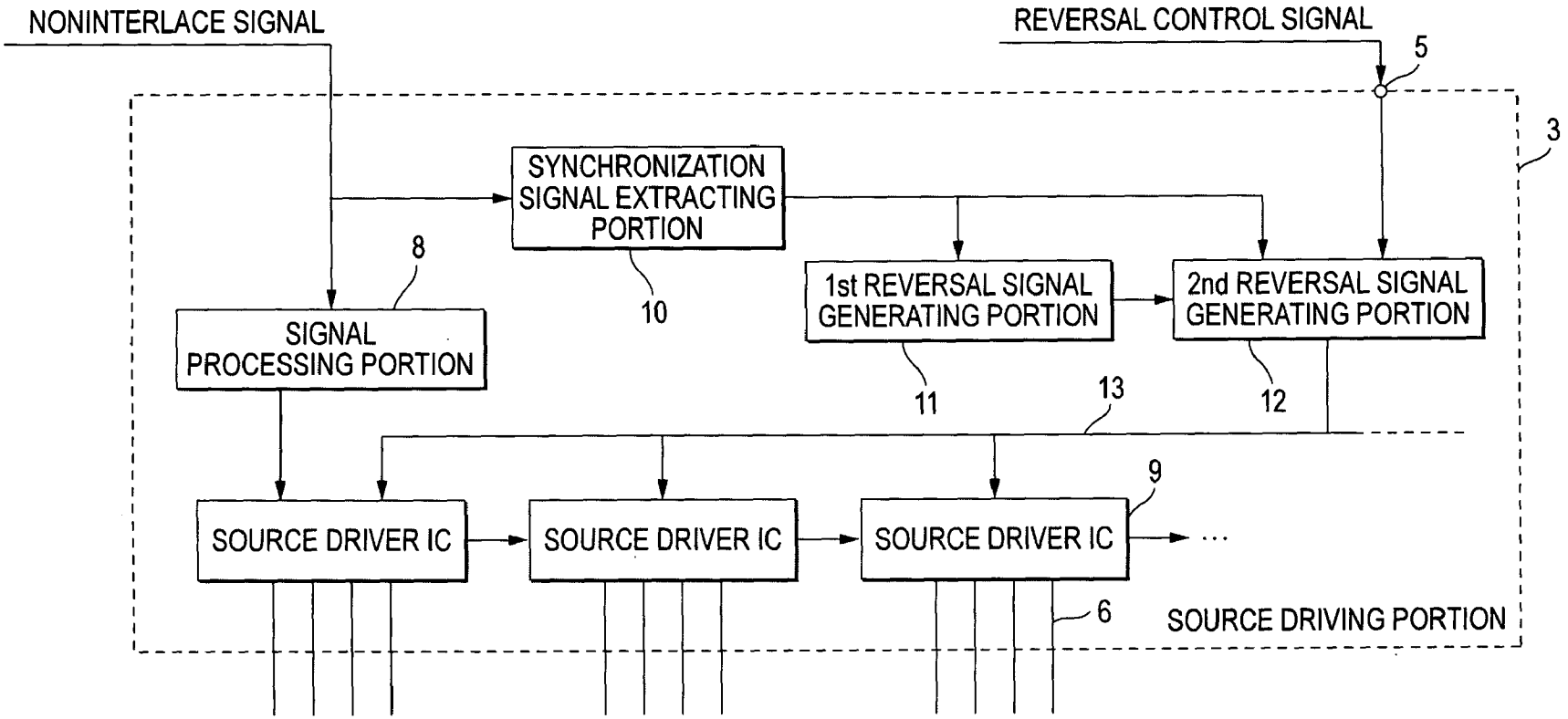
FIG. 2 is a block view showing an example of the configuration of a primary portion of the liquid crystal display apparatus shown in FIG. 1.

FIG. 2 is a block view showing an example of the configuration of a primary portion of the liquid crystal display apparatus shown in FIG. 1. FIG. 2 shows the source driving portion 3 in detail. This source driving portion 3 includes a signal processing portion 8, source driver ICs 9, a synchronization signal extracting portion 10, a first reversal signal generating portion 11, and a second reversal signal generating portion 12.

The signal processing portion 8 determines a signal voltage, which is applied to each of the pixels, according to the amplitude level of the noninterlace signal and sequentially outputs voltage data, which represent the determined voltages, to the source driver ICs 9. The synchronization signal extracting portion 10 extracts a horizontal synchronization signal and a vertical synchronization signal from a noninterlace signal. A vertical start pulse signal is extracted every vertical scanning period as the vertical synchronization signal. These synchronization signals are sequentially outputted to the first reversal signal generating portion 11 and the second reversal signal generating portion 12.

The first reversal signal generating portion 11 generates a first polarity reversal signal, which is used for reversing the polarity of a signal voltage to be applied to each of pixels, according to the horizontal synchronization signal and the vertical synchronization signal. This first polarity reversal signal is a signal for an alternating current driving operation of reversing the polarity of a signal voltage, which is applied to each of the pixels, every vertical scanning period. That is, the positive or negative polarity of the signal voltage applied to each of the pixels can be reversed every frame by utilizing the first polarity reversal signal. It is assumed herein that a reversal signal is generated according to a dot inversion driving method, according to which the polarity of a signal voltage applied to each of the pixels is set by reversing the polarity of a signal voltage applied to a pixel adjacent thereto, as the first polarity reversal signal. The generated first polarity reversal signals are serially outputted to the second reversal signal generating portion 12.

The second reversal signal generating portion 12 outputs a second polarity reversal signal 13 according to a reversal control signal, to the vertical synchronization signal outputted from the synchronization signal extracting portion 10 and to the first polarity reversal signal outputted from the first reversal signal generating portion 11. The reversal control signal is inputted from the reversal control signal generating portion A2 through an input terminal 5 provided in the source driving portion 3. The second polarity reversal signal 13 is generated by reversing, when the reversal control signal is inputted thereto, the polarity of the first polarity reversal signal every frame. That is, when the reversal control signal is inputted thereto, the second polarity reversal signal 13 is generated from the first polarity reversal signal by reversing the polarity thereof every vertical synchronization period in synchronization with the vertical synchronization signal. When the reversal control signal is not inputted thereto, the first polarity reversal signal is outputted as the second polarity reversal signal 13. The second polarity reversal signals 13 generated in this manner are sequentially outputted to the source driver ICs 9.

Each of the source driver ICs 9 is switching device driving means for driving a thin film transistor, which is associated with each of the pixels, according to the second polarity reversal signal 13 and the voltage data and sequentially applies signal voltages to the source lines 6 thereby to drive each of the thin film transistors.

Figure 3:
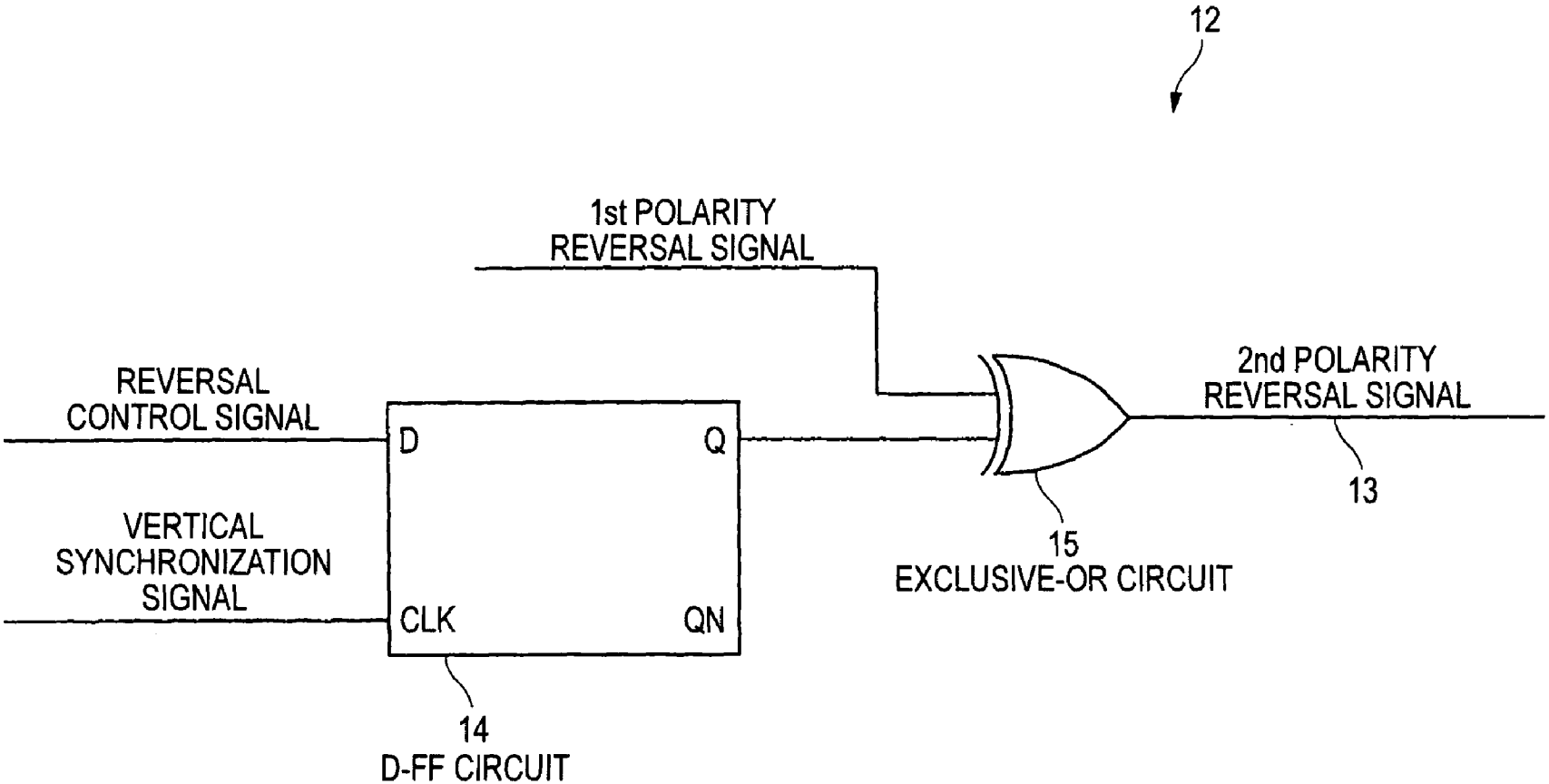
FIG. 3 is a circuit view showing an example of the configuration of a primary portion of a source driving portion shown in FIG. 2.

FIG. 3 is a circuit view showing an example of the configuration of a primary portion of a source driving portion shown in FIG. 2. The second reversal signal generating portion 12 of this embodiment may include a D-FF (Delay-Flip Flop) circuit 14 and an exclusive-OR circuit 15. The D-FF circuit 14 has four terminals, that is, a data terminal D, a clock terminal CLK, and output terminals Q and QN. The D-FF circuit 14 is a delay circuit for outputting a signal representing a time-varying level of a signal, which is inputted to the data terminal D, in synchronization with a signal inputted to the clock terminal CLK.

The exclusive-OR circuit 15 is a logic circuit for outputting an exclusive-OR of two input signals. For example, in a case where the amplitude level of a signal is binarized as H (High) and L (Low), when both the amplitude levels of two input signals are H or L, a signal, whose signal level is L, is outputted. When both the amplitude levels of two input signals differ from each other, a signal, whose signal level is H, is outputted.

The second reversal signal generating portion 12 of a simple configuration can be realized by using such circuits. Concretely, a reversal control signal is inputted to the data terminal D of the D-FF circuit 14. A vertical synchronization signal is inputted to the clock terminal CLK thereof. An output signal from the output terminal Q of the D-FF circuit 14, and a first polarity reversal signal are inputted to the exclusive-OR circuit 15. An output terminal thereof at that time is a second polarity reversal signal 13.

FIGS. 4A and 4B are tables showing the corresponding relation between the input and the output in the D-FF circuit and the exclusive-OR circuit shown in FIG. 3. FIG. 4A shows a truth table of the D-FF circuit 14. For example, the amplitude level of a signal is binarized as H (High) and L (Low), when the amplitude level of the reversal control signal inputted to the data terminal D is H, the amplitude level of the output signal, which is outputted from the output terminal Q in synchronization with the rise of the amplitude level of the vertical synchronization signal inputted to the clock terminal CLK, is H. Further, when the amplitude level of the reversal control signal is L, the amplitude level of the output signal outputted in synchronization with the rise of the amplitude level of the vertical synchronization signal is L. Therefore, a signal representing change in the amplitude level of the reversal control signal can be outputted in synchronization with the vertical synchronization signal.

FIG. 4B shows a truth table of the exclusive-OR circuit 15. When both the amplitude levels of the two input signals, that is, the first polarity reversal signal and the output signal from the D-FF circuit 14 are H or L, a signal having an amplitude level L is outputted as the second polarity reversal signal 13. Further, when the amplitude levels of the two input signals differ from each other, a signal having an amplitude level H is outputted. That is, when the amplitude level of the reversal control signal is H, the polarity of the first polarity reversal signal is reversed in synchronization with the vertical synchronization signal, and outputted. Further, when the amplitude of the reversal control signal is L, the first polarity reversal signal is outputted as the second polarity reversal signal 13 in synchronization with the vertical synchronization signal. Therefore, the second polarity reversal signal 13 can be generated by reversing the polarity of the first polarity reversal signal every frame according to the change in the amplitude level of the reversal control signal.

Figure 5:
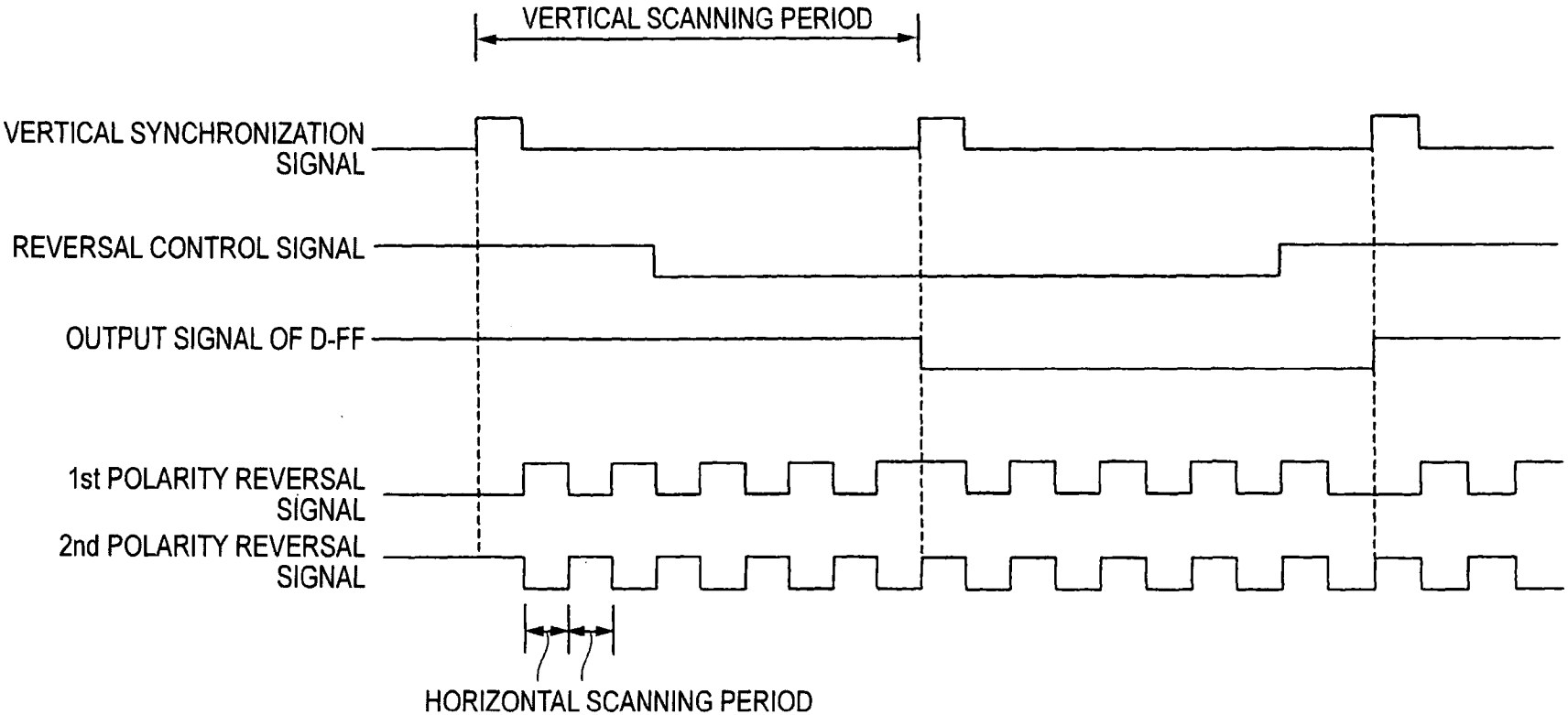
FIG. 5 is a time chart showing change in the amplitude level of each of input and output signals with time in a second reversal signal generating portion shown in FIG. 2 versus time.

FIG. 5 is a time chart showing change in the amplitude level of each of input and output signals in a second reversal signal generating portion shown in FIG. 2 versus time. When the amplitude level of the reversal control signal changes from H to L in a certain vertical scanning period, the amplitude level of an output signal of the D-FF circuit 14 changes from H to L in synchronization with the rise of the vertical synchronization signal. In response to the change in the amplitude level of this output signal, the polarity of the second polarity reversal signal 13 is obtained by noninverting, that is, becomes the same as the polarity of the first polarity reversal signal. Conversely, when the amplitude level of the reversal control signal changes from L to H, the amplitude level of an output signal of the D-FF circuit 14 changes from L to H in synchronization with the rise of the vertical synchronization signal. In response to the change in the amplitude level of this output signal, the polarity of the second polarity reversal signal 13 is set by reversing that of the first polarity reversal signal. That is, according to the change in the amplitude level of the reversal control signal, the polarity of the first polarity reversal signal is reversed in synchronization with the vertical synchronization signal. Thus, the second polarity reversal signal 13 is generated.

Figure 6:
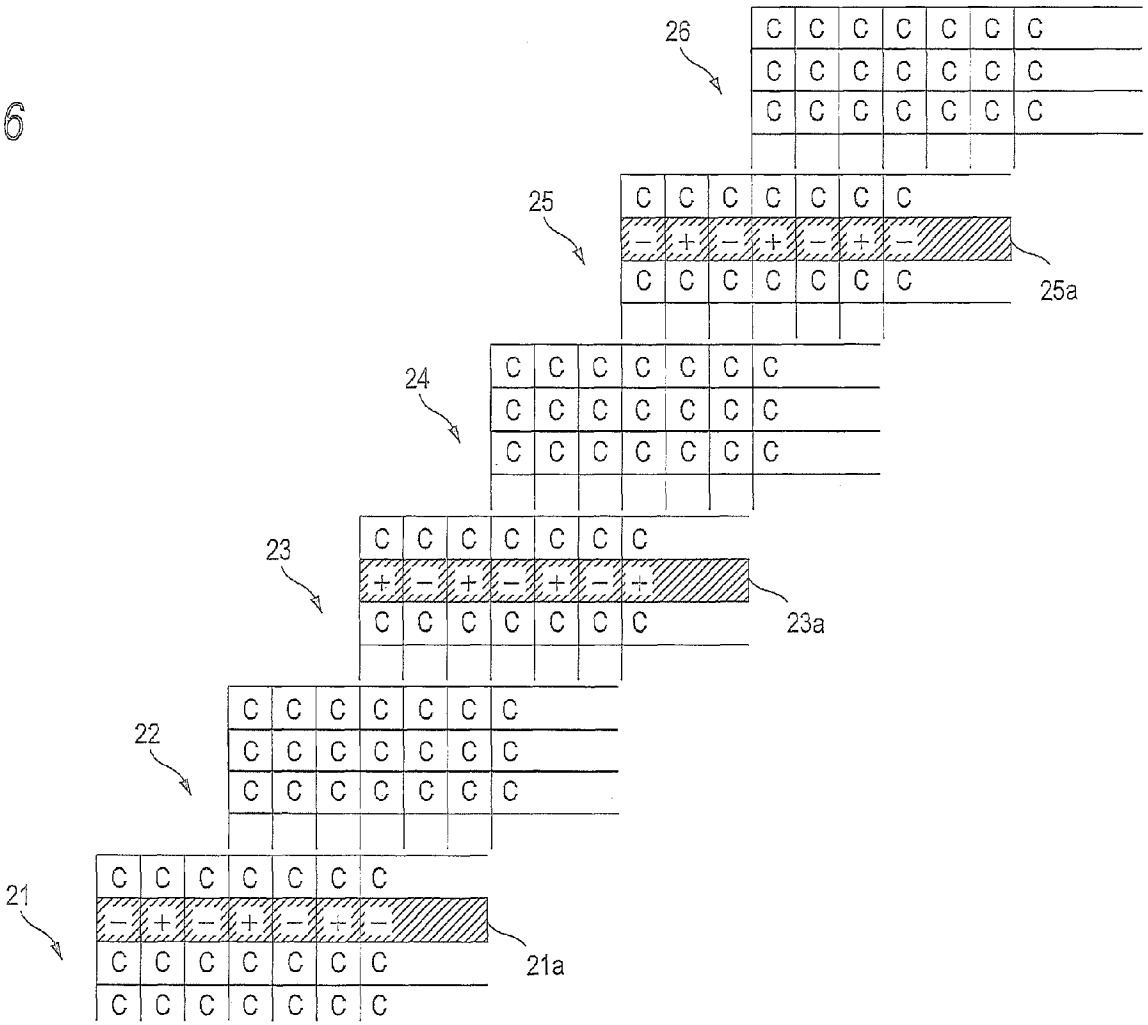
FIG. 6 is a state transition view showing indication on a display screen of the liquid crystal display apparatus shown in FIG. 1.
Figure 13:
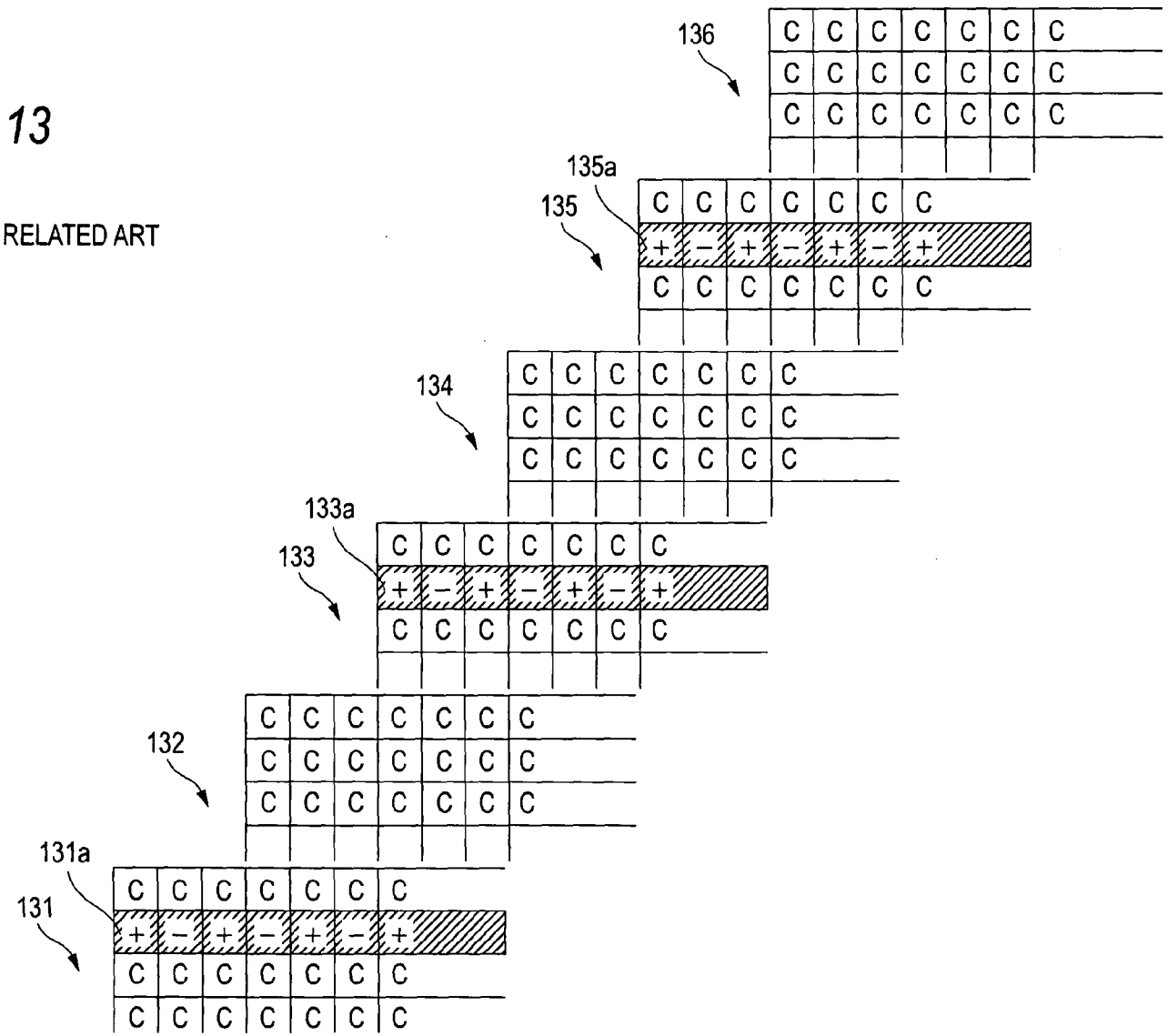
FIG. 13 RELATED ART
FIG. 13 is a state transition view illustrating the display screen every frame in the conventional liquid crystal display apparatus.

FIG. 6 is a state transition view showing indication on a display screen of the liquid crystal display apparatus shown in FIG. 1. It is preferable for effectively preventing a direct-current component from being accumulated in the pixels that the reversal control signal is outputted, for example, every 4 frame. FIG. 6 shows the manner of indication on the screen. It is assumed herein that the application of the signal voltage is performed according to the second polarity reversal signal 13, which is generated by reversing the polarity of the first polarity reversal signal, only 1 frame immediately after the reversal control signal is inputted thereto. Even-numbered frames 21 and 25 correspond to this 1 frame. At that time, an alternating current driving operations can be performed on display areas 21*a*, 23*a*, and 25*a*, respectively associated with the even-numbered frames 21, 23, and 25, as is apparent from the comparison with the conventional case shown in FIG. 13. Consequently, an occurrence of image sticking of the pixel can be prevented.

Figure 7:
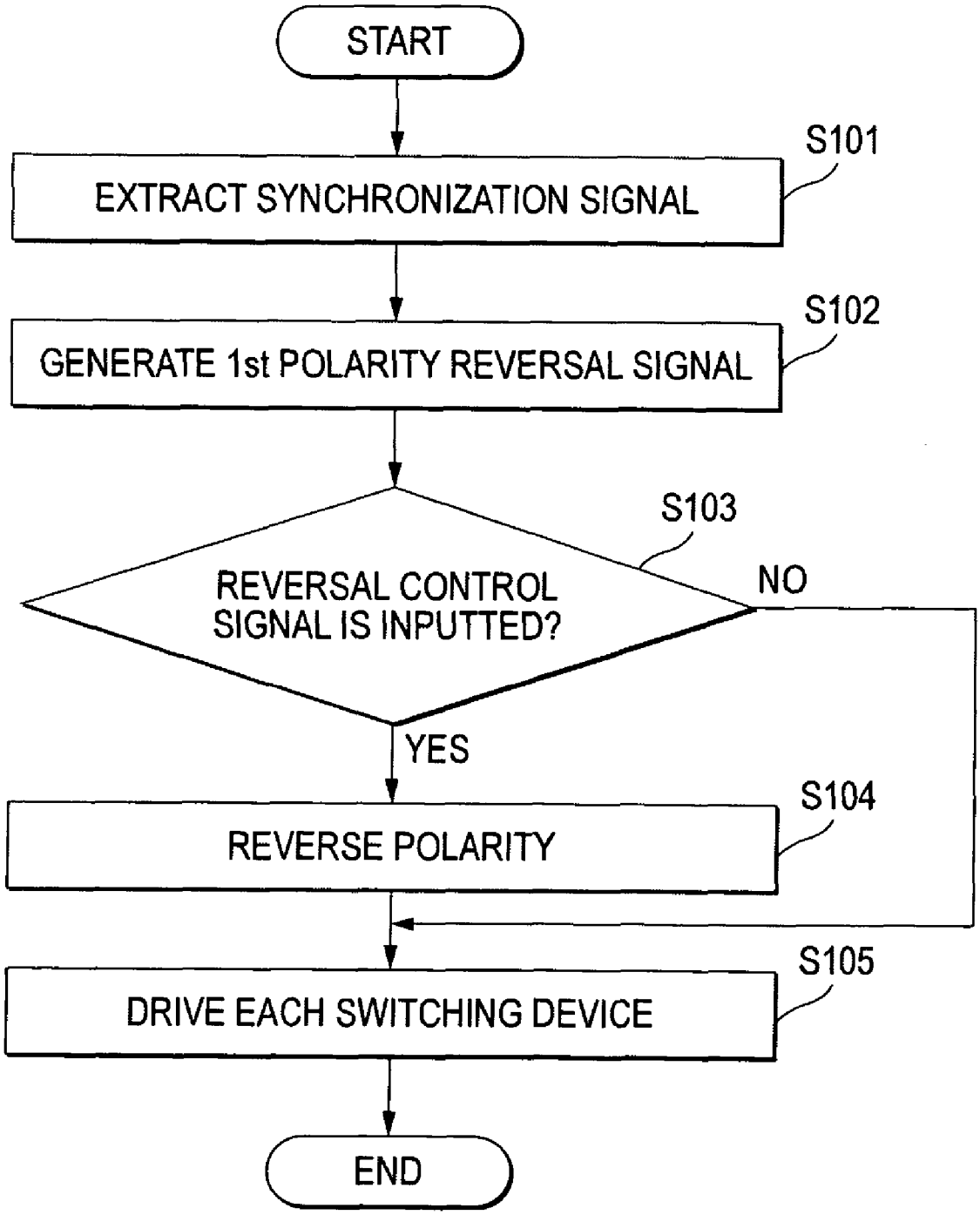
FIG. 7 is a flowchart showing an example of an alternating current driving operation of the liquid crystal display apparatus shown in FIG. 1.
Figure 8:
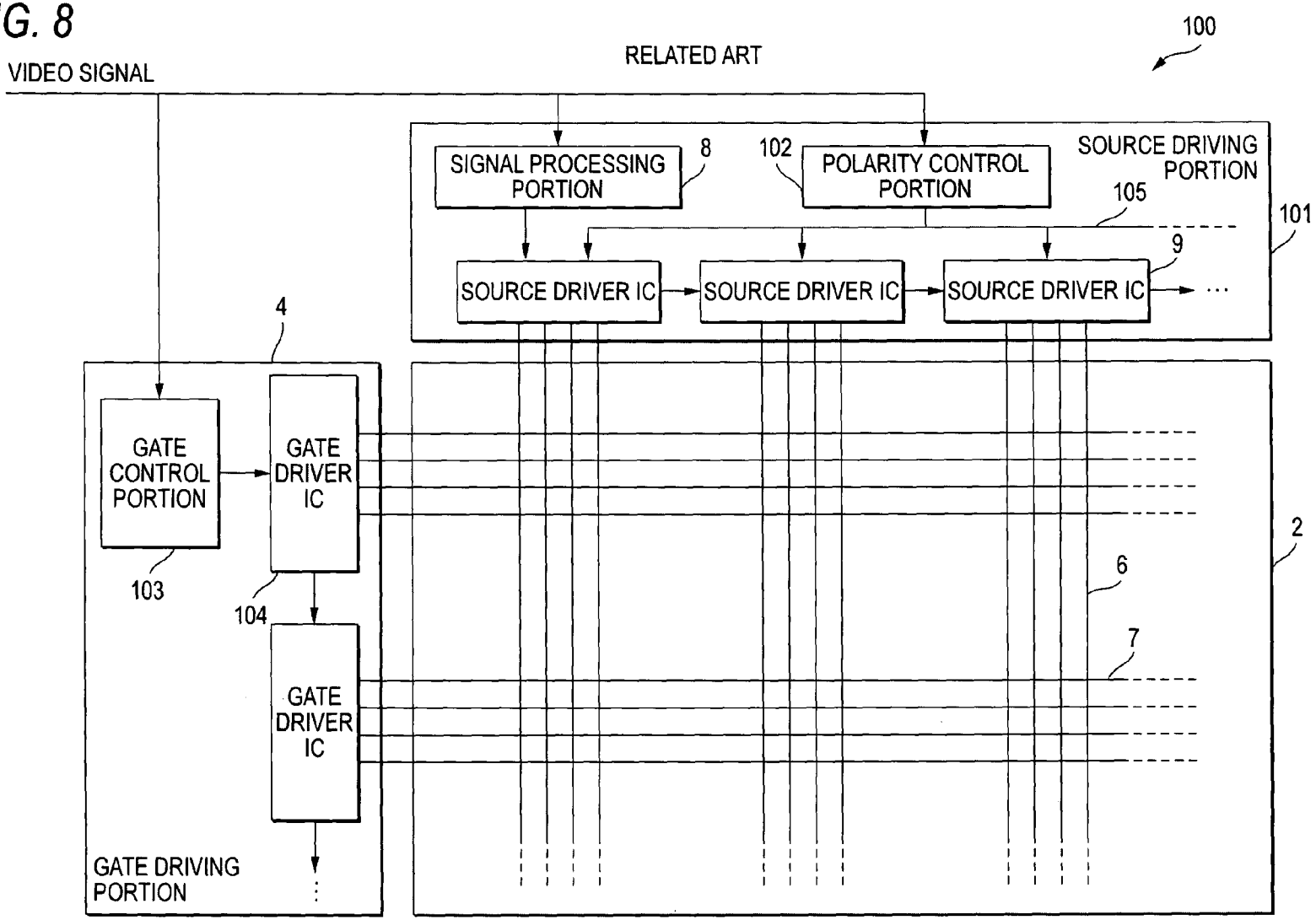
FIG. 8 is a view illustrating the configuration of a conventional liquid crystal display apparatus.
Figure 9:
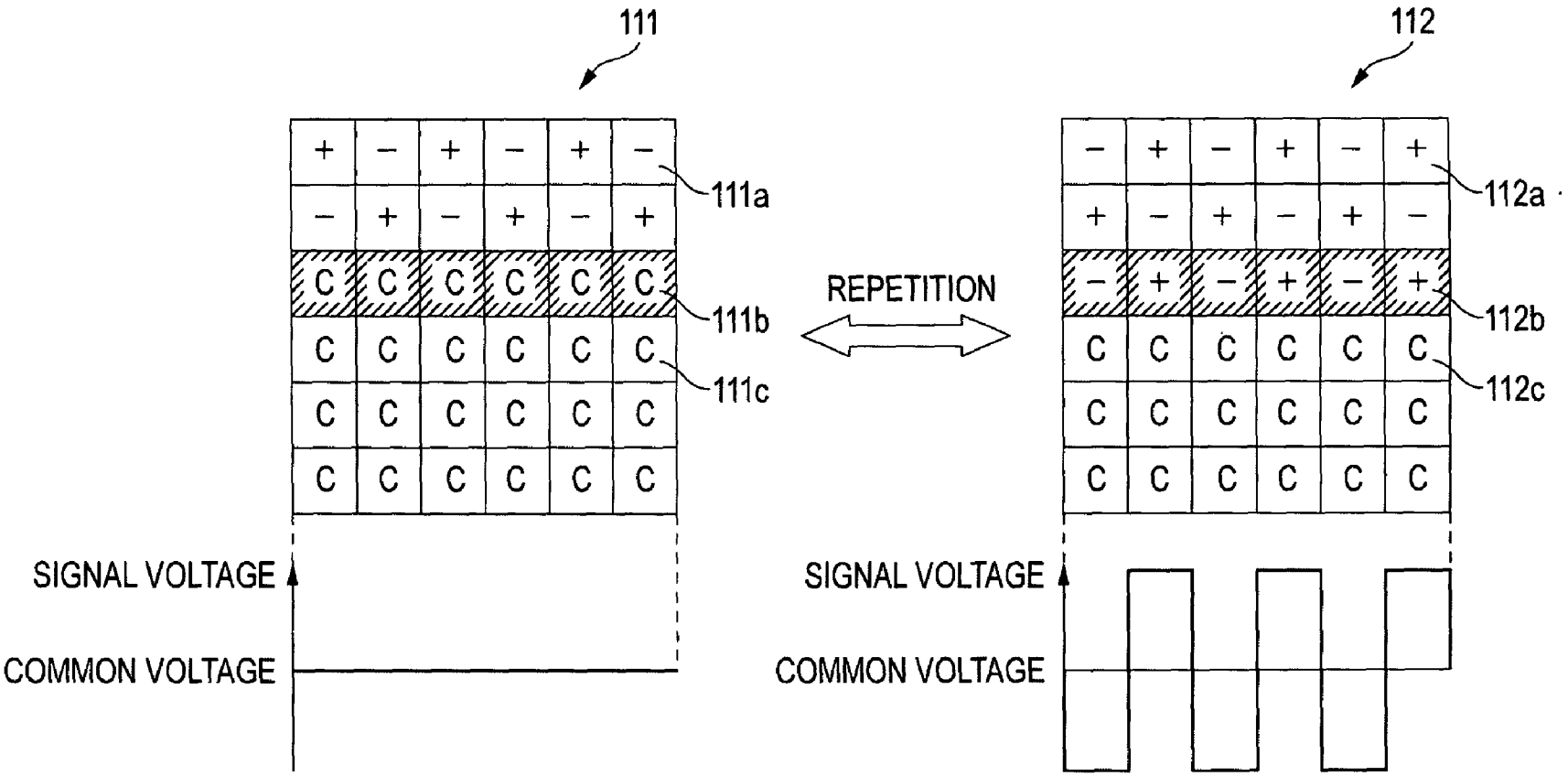
FIG. 9 RELATED ART
FIG. 9 is a state view illustrating a display screen, on which a noninterlace signal is displayed, of the conventional liquid crystal display apparatus.
Figure 10:
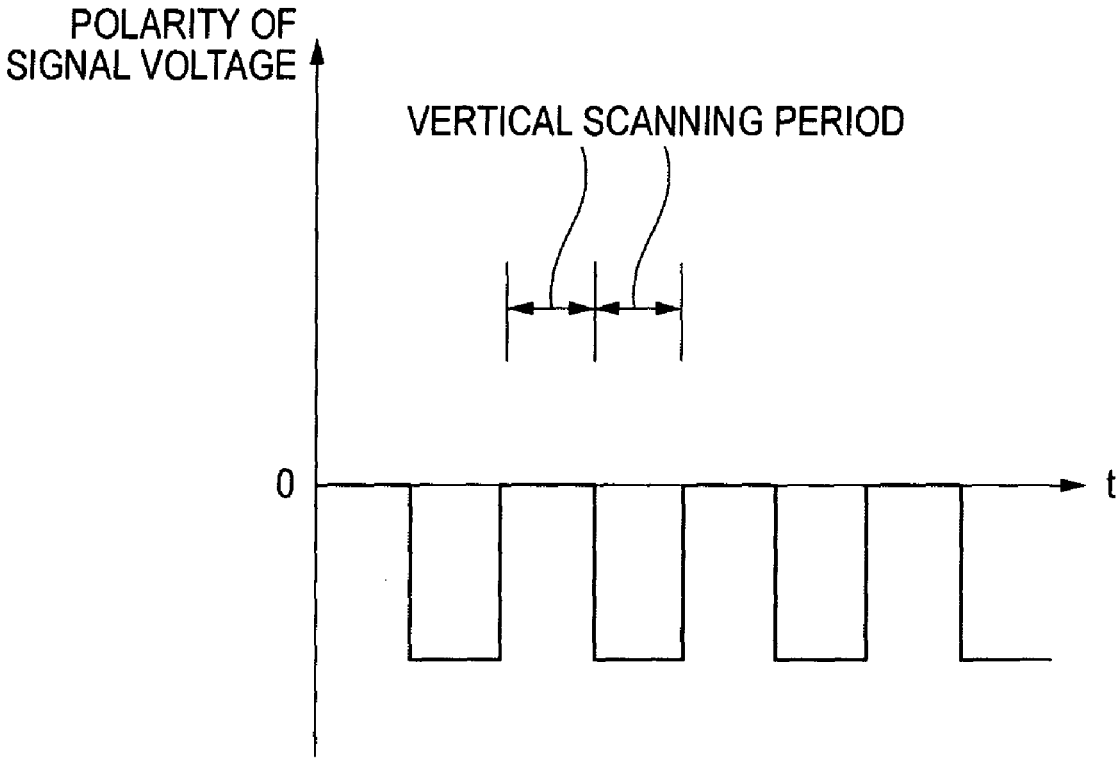
FIG. 10 RELATED ART
FIG. 10 is a view illustrating the polarity of a signal voltage applied to a pixel every vertical scanning period in the conventional liquid crystal display apparatus.
Figure 11:
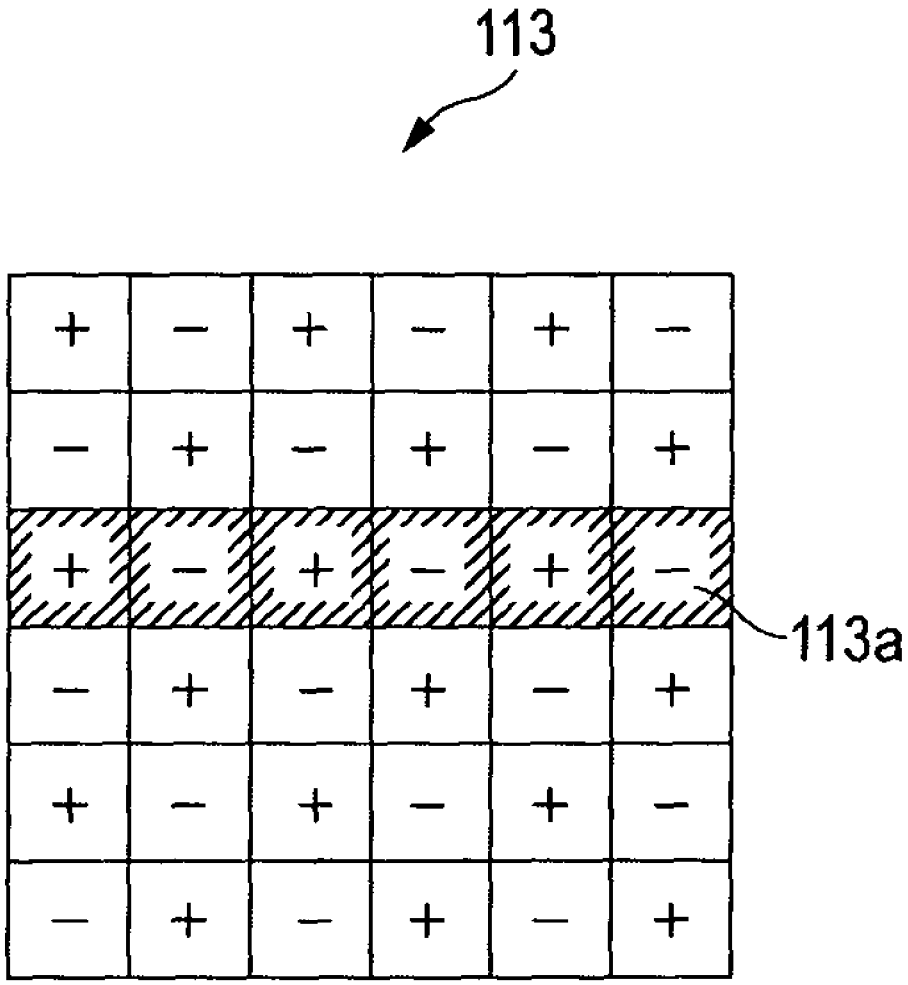
FIG. 11 RELATED ART
FIG. 11 is a state view illustrating a display screen, on which a noninterlace signal is displayed, in the conventional liquid crystal display apparatus.
Figure 12:
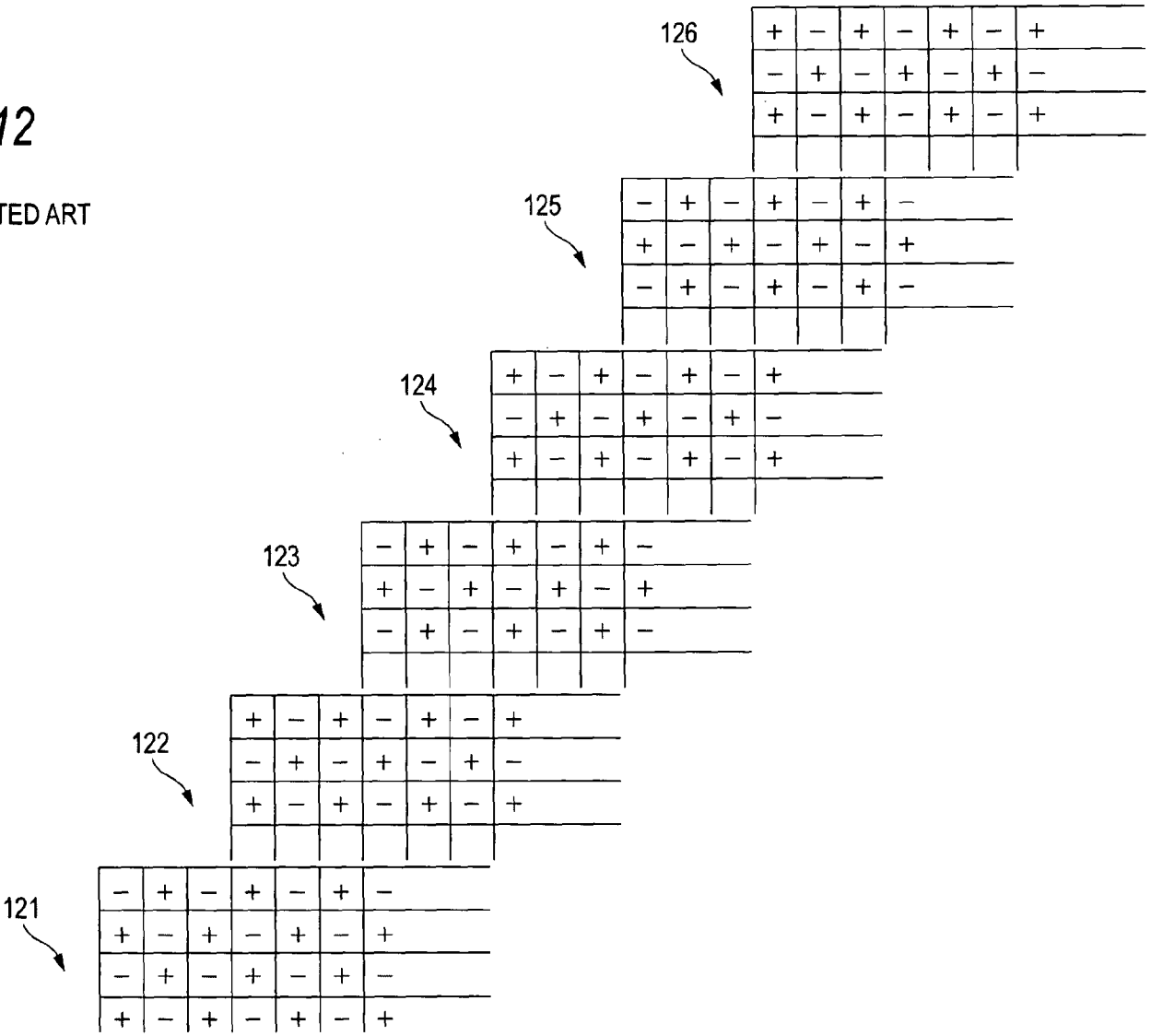
FIG. 12 RELATED ART
FIG. 12 is a state transition view illustrating the display screen every frame in the conventional liquid crystal display apparatus.

FIG. 7 is a flowchart showing an example of an alternating current driving operation of the liquid crystal display apparatus shown in FIG. 1, which includes steps S101 to S105. First, when a noninterlace signal is inputted from the interpolation processing portion A1 to the synchronization signal extracting portion 10, this portion 10 extracts a horizontal synchronization signal and a vertical synchronization signal therefrom (in step S101). The first reversal signal generating portion 11 generates a first polarity reversal signal according to these synchronization signals (in step S102).

Subsequently, when the reversal control signal is inputted from the reversal control signal generating portion A2 to the second reversal signal generating portion 12, this portion 12 reverses the polarity thereof in synchronization with a vertical synchronization signal to thereby generate a second polarity reversal signal 13 from the first polarity reversal signal (steps S103 and S104). Conversely, when no reversal control signal is inputted thereto, the first polarity reversal signal is outputted as the second polarity signal 13. Each of the source drivers IC9 drive the switching devices of the pixels on the basis of the generated second polarity reversal signal 13 according to voltage data sent from the signal processing portion 8.

According to this embodiment of the invention, a second polarity reversal signal 13 is generated according to a reversal control signal. Thus, in a case where a same image is continuously displayed over plural frames, and where a pixel, in which alternating current driving cannot be performed, appears, the polarity of a signal voltage is reversed according to a reversal control signal. Thus, a pixel can be prevented from causing image sticking.

What is claimed is:

1. A liquid crystal display apparatus comprising:

synchronization signal extracting means for extracting a vertical synchronization signal from a noninterlace signal;

first reversal signal generating means for generating a first polarity reversal signal that causes reversal of polarity of a signal voltage every frame for a switching device associated with each of pixels according to the vertical synchronization signal;

reversal control signal generating means for generating a reversal control signal when an odd-numbered frame and an even-numbered frame comprise a predetermined number of pixels or more having a difference in luminance between the odd-numbered frame and the even-numbered frame of the noninterlace signal that exceeds a predetermined threshold value, and the odd-numbered frame and the even-numbered frame are repeatedly inputted to the reversal control signal generating means for a plurality of frames greater than or equal to a predetermined number of times;

second reversal signal generating means for outputting a second polarity reversal signal according to the reversal control signal, wherein the second reversal signal generating means outputs the second reversal signal every frame according to a vertical synchronization period in synchronization with the vertical synchronization signal by reversing polarity of the first polarity reversal signal when the reversal control signal is input, and wherein the second reversal control signal generating means outputs the first polarity reversal signal as the second reversal signal when the reversal control signal is not input; and switching device driving means for driving each of switching devices according to the second polarity reversal signal.

2. The liquid crystal display apparatus according to claim 1, further comprising:

interpolation processing means for generating the noninterlace signal by performing scanning line interpolation on an interlace signal.

3. The liquid crystal display apparatus according to claim 1, wherein the second reversal signal generating means comprises a delay flip-flop circuit and an exclusive-OR circuit, the reversal control signal and the vertical synchronization signal are inputted to the delay flip-flop circuit, and an output signal of the delay flip-flop circuit and the first polarity reversal signal are inputted to the exclusive-OR circuit to thereby generate a second polarity reversal signal.

4. A liquid crystal display apparatus comprising:

synchronization signal extracting means for extracting a vertical synchronization signal from a noninterlace signal;

first reversal signal generating means for generating a first polarity reversal signal that causes reversal of polarity of a signal voltage every frame for a switching device associated with each of pixels according to the vertical synchronization signal;

an input terminal for receiving a reversal control signal obtained when an odd-numbered frame and an even-numbered frame comprise a predetermined number of pixels or more having a difference in luminance between the odd-numbered frame and the even-numbered frame of the noninterlace signal that exceeds a predetermined threshold value, and the odd-numbered frame and the even-numbered frame are repeatedly inputted to the input terminal for a plurality of frames greater than or equal to a predetermined number of times;

second reversal signal generating means for outputting a second polarity reversal signal according to the reversal control signal, wherein the second reversal signal generating means outputs the second reversal signal every frame according to a vertical synchronization period in synchronization with the vertical synchronization signal by reversing polarity of the first polarity reversal signal when the reversal control signal is input to the input terminal, and wherein the second reversal control signal generating means outputs the first polarity reversal signal as the second reversal signal when the reversal control signal is not input to the input terminal; and switching device driving means for driving each of switching devices according to the second polarity reversal signal.

5. An alternating current driving method for a liquid crystal display apparatus comprising:

extracting a vertical synchronization signal from a noninterlace signal;

generating a first polarity reversal signal that causes reversal of polarity of a signal voltage every frame for a switching device associated with each of pixels according to the vertical synchronization signal;

generating a reversal control signal when an odd-numbered frame and an even-numbered frame comprise a predetermined number of pixels or more having a difference in luminance between the odd-numbered frame and the even-numbered frame of the noninterlace signal that exceeds a predetermined threshold value, and the odd-numbered frame and the even-numbered frame are repeatedly inputted for a plurality of frames greater than or equal to a predetermined number of times;

outputting a second polarity reversal signal every frame according to the reversal control signal and according to a vertical synchronization period in synchronization with the vertical synchronization signal by reversing polarity of the first polarity reversal signal when the reversal control signal is input, and outputting the first polarity reversal signal as the second reversal signal when the reversal control signal is not input; and driving each of switching devices according to the second polarity reversal signal.

6. The liquid crystal display apparatus according to claim 1, wherein the reversal control signal generating means outputs the reversal control signal every four frames, and wherein the second reversal signal generating means generates the second polarity reversal signal by reversing the polarity of the first polarity reversal signal only one frame immediately after the reversal control signal is inputted.

* * * * *